US005192063A

United States Patent [19]

Peterson et al.

[11] Patent Number: 5,192,063

[45] Date of Patent: Mar. 9, 1993

[54] CLAMP ARM

[75] Inventors: Jeffrey M. Peterson, Menomonee Falls; Ronald P. Evers, Cedarburg; Peter G. Rusch, Oconomowoc; Duane D. Dwyer, Milwaukee; Barry L. Macky, Grafton; James D. Boldt, Wauwatosa, all of Wis.

[73] Assignee: Applied Power Inc., Butler, Wis.

[21] Appl. No.: 758,028

[22] Filed: Sep. 12, 1991

[51] Int. Cl.[5] ..... B25B 1/24

[52] U.S. Cl. ..... 269/257; 269/25; 269/282

[58] Field of Search ..... 269/257, 271, 275, 282, 269/25, 32, 77, 78; 403/261, 326, 375, 373

[56] References Cited

PUBLICATIONS

"Vektor Flo" brochure, two pages, entitled *Power Clamping That Works.*

"Swift Sure" brochure, Sep. 1988, four pages.

"Vlier Enerpac" catalog, pp. 14–23, publication #8986R.

Hytec brochure No. H-88, three pages.

Jergens Inc. brochure, three pages.

*Primary Examiner*—Bruce M. Kisliuk

*Assistant Examiner*—Eileen P. Morgan

[57] ABSTRACT

A clamp arm for attachment to the plunger of a clamping cylinder has a body with a central opening for receiving the plunger and a working arm portion extending outwardly from the opening. The body has a radial slot extending from the central opening and a bore in the body that extends transversely through the slot. One portion of the bore is threaded to receive a headed bolt to draw the sides of the slot together to lock the body on the plunger. The body is axially restrained on the plunger by means of a ring received in a counter bore above the transverse bore for the headed bolt. The ring is received in a circumferential groove in the plunger. Alternatively, the headed bolt that is used to draw the sides of the slot together engages a circumferential groove in the plunger.

9 Claims, 2 Drawing Sheets

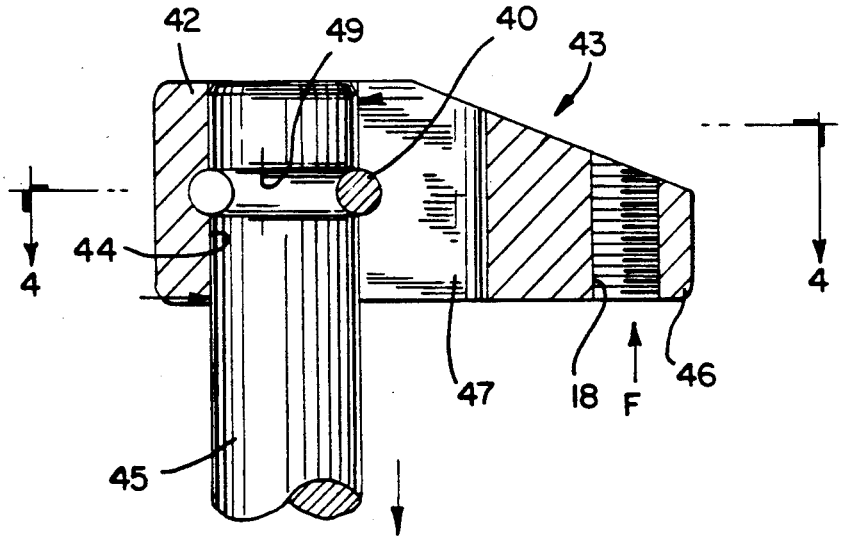
FIG. 3
FIG. 4
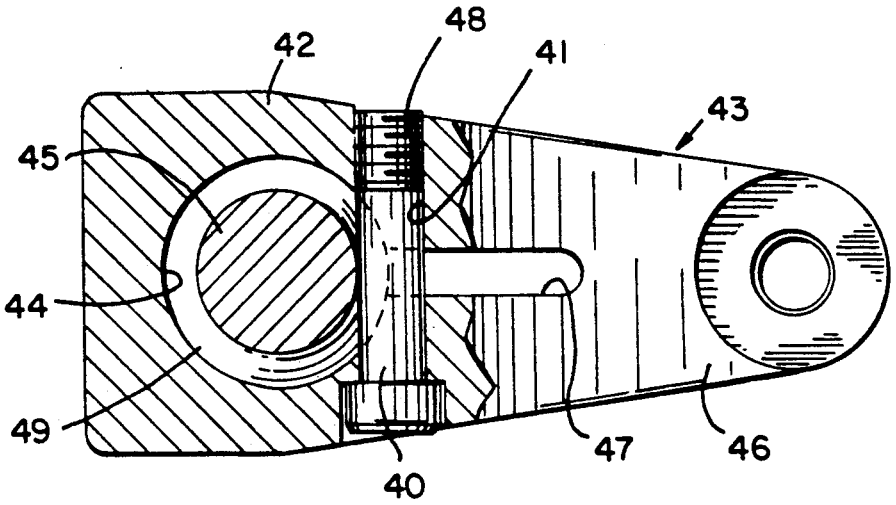

CLAMP ARM

BACKGROUND OF THE INVENTION

This invention relates to the clamping of work pieces and other items required to be held in place while work is performed, and is particularly directed to an improved clamp arm for mounting on the plunger of a clamping cylinder.

Power assisted clamping devices are used to hold work pieces on the work tables in a machining operation or an automatic assembly operation. The clamping devices typically include a pneumatic or hydraulically operated cylinder which raises and lower a plunger to which is attached a clamp arm that engages the work piece and hold it securely in place. The cylinder may function to simply raise or lower the plunger, and thereby the clamp arm, or may also function to rotate the plunger as it is moved axially to thereby swing the clamp arm out of the way for ease of withdrawal and replacement of the work piece.

It is desirable to mount the clamp arm on the plunger in a manner that allows the clamp arm to be positioned at any point about the perimeter of the plunger while being locked in the selected peripheral position and being restrained axially on the plunger. Such mounting is typically accomplished by holding the clamp arm on the end of the plunger by use of a capscrew threaded into an axial bore in the end of the plunger.

The plunger is subjected to a number of loads, both those caused by the clamping forces and those resulting from the method of mounting. The clamping forces will exert a bending load on the top of the plunger because the arm engages the work piece at a point spaced from the axis of the plunger. Mounting the clamp arm through use of a capscrew threaded into an axial bore in the plunger end reduces the effective cross-section of the plunger and thereby reduces its ability to withstand the bending forces. Using a capscrew to mount the clamp arm on the plunger also introduces torque loads on the plunger. This may be undesirable, particularly if the plunger is a part of a cylinder which both axially moves and rotates to swing the clamp arm.

The present invention eliminates the application of a torque load on the plunger in the mounting of the clamp arm and also maximizes the bending load capacity of the plunger.

SUMMARY OF THE INVENTION

In accordance with the invention, a clamp arm adapted for attachment to the plunger of a clamp includes a body having a central opening for receiving the plunger and at least one working arm portion extending outwardly from the opening. The body also includes a slot extending radially from the central opening and a bore in the body that extends transversely through the slot. One portion of the bore is threaded to receive a headed bolt to draw the sides of the slot together to lock the body on the plunger. The body is axially restrained on the plunger by means that includes an element mounted in the body for engagement with a circumferential groove in the plunger.

The invention also relates to a clamp arm assembly for a clamping cylinder, the assembly including a clamp arm as described above in combination with a plunger having a circumferential groove adjacent one end.

In the preferred embodiments, the axial restraint means includes a ring that is received in a counterbore in the body above the transverse bore for the headed bolt. The ring is received in the groove of the plunger. Alternatively, the headed bolt used to draw the sides of the slot together may be used for the axial restraint by locating the transverse bore partially through the central opening so that a portion of the headed bolt projects into the opening where it can engage the groove of the plunger.

The clamp arm may have a pair of working arm portions extending in opposite directions from the central opening, and each of the working arm portions may be provided with a threaded hole to receive a swivel pad or bolt for close clamping action to the work piece.

The clamp arm is mountable at any position about the periphery of the plunger and is easily and quickly mounted and removed. The mounting does not weaken the capacity of the plunger to withstand bending loads.

It is an object of the present invention to provide a clamp arm for mounting on the plunger of a clamp cylinder which does not result in reduction in the bending load capacity of the plunger.

It is another object of the invention to provide such a clamp arm which is not mounted by the use of a screw received into a threaded axial bore in the end of the plunger.

It is also an object of the invention to provide a clamp arm construction that is easily and quickly mounted on the end of a plunger without applying axial torque loads to the plunger during mounting.

The forgoing and other objects and advantages of the invention will appear in the following detailed description. In the description, reference is made to the accompanying drawing which illustrates preferred embodiments of the invention.

BRIEF DESCRIPTION OF THE DRAWING

FIG. 3 is a view similar to FIG. 1 but showing an alternative embodiment of the clamp arm; and FIG. 4 is a top view of the embodiment of FIG. 3 to a larger scale and width portions in section in the plane of the line 4—4 of FIG. 3.

DETAILED DESCRIPTION OF THE PREFERRED EMBODIMENTS

Figure 1:
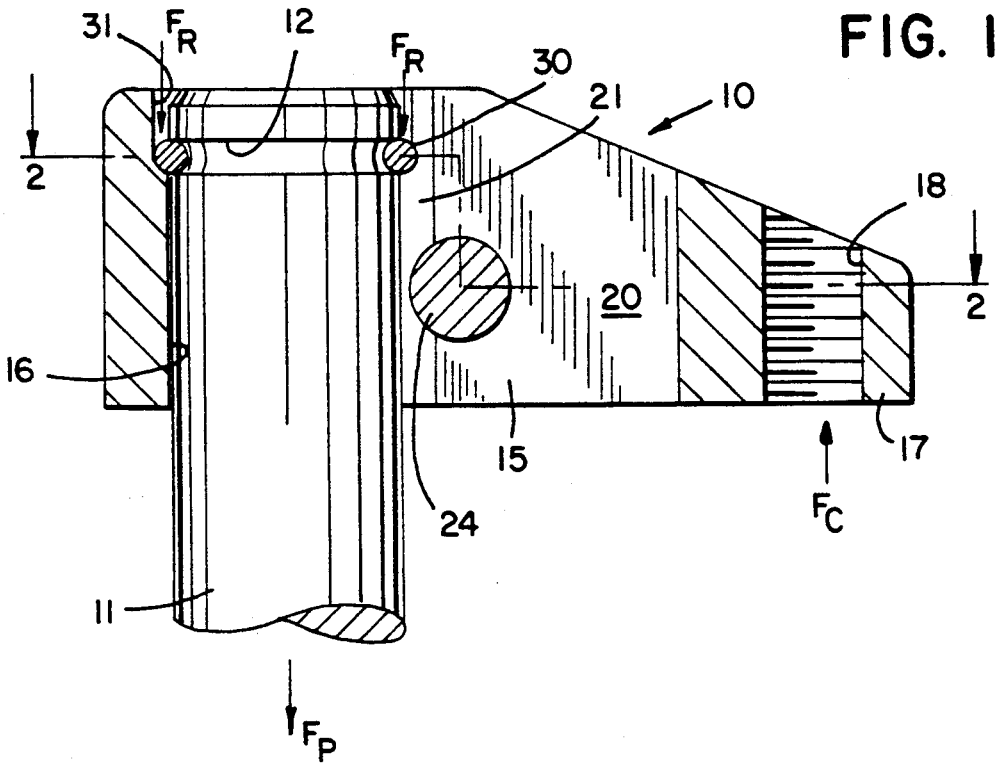
FIG. 1 is a side view, partially in section, of a clamp arm in accordance with the present invention mounted on the plunger of a clamping cylinder.
Figure 2:
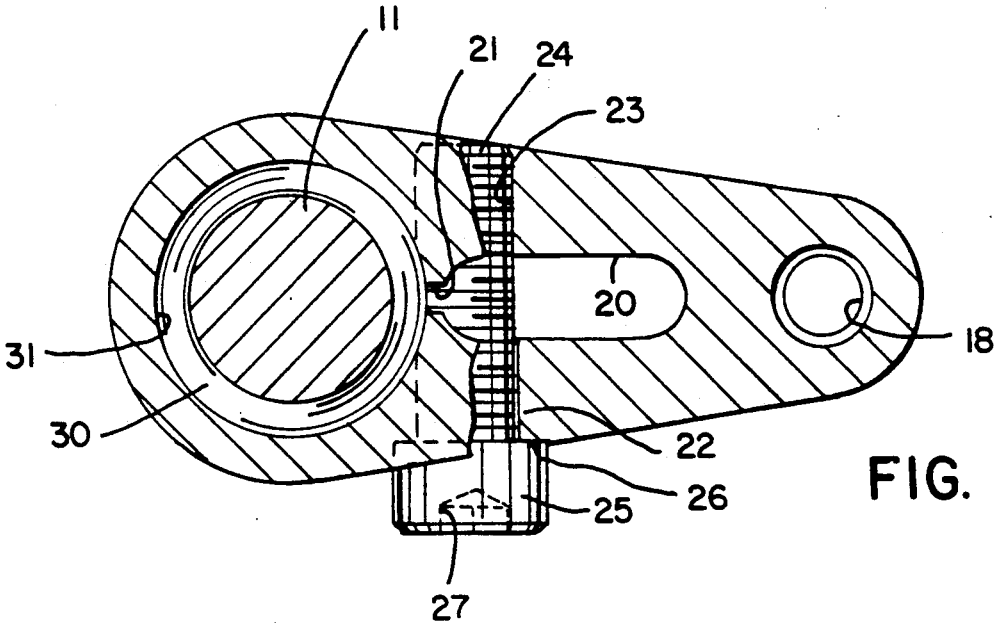
FIG. 2 is a top view in section of the clamp arm of FIG. 1 to a larger scale and taken in the plane of the line 2—2 of FIG. 1.

Referring to FIGS. 1 and 2, the clamp arm 10 is adapted to be mounted on the top end of a plunger 11 of a clamping cylinder (not shown). The cylinder may be of known construction and may take a variety of forms including those in which the cylinder acts to pull the down the plunger 11 to engage the clamp arm 10 with a work piece and other versions in which the cylinder rotates the plunger 11 through an arc to swing the clamp arm 10 during engagement and release. The plunger 11 is in the form of a circular cylindrical shaft having a circumferential groove 12 spaced from its top end.

The clamp arm 10 has a body portion 15 provided with a circular cylindrical central opening 16 and a working arm portion 17 that extends from the central opening 16. The outer end of the working arm portion 17 includes a threaded arm hole 18 to receive the attachment of a swivel pad or bolt for close clamping action, as is known in the art.

A slot 20 is formed in the body extending radially from the central opening 16 and into the working arm portion 17. The slot 20 is open to the central opening 16 but has its opposite end closed. The end 21 of the slot 20 that is adjacent to the central bore 16 is substantially narrower than the remainder of the slot 20 so that most of the circumference of the central bore 16 is uninterrupted. A transverse bore 22 extends through the body 15 and across the slot 20. One end 23 of the bore 22 is provided with threads to receive the threaded end of a headed bolt 24. The head 25 of the bolt 24 is adapted to bear against a shoulder formed by a counterbore 26. The head 25 of the bolt 24 may be provided with a hex recess 27 to receive a hex wrench for rotation of the bolt 24. As will be appreciated from the drawings, tightening of the bolt 24 will tend to move the two sides of the slots 20 together and thereby locks the clamp arm 10 onto the plunger 11. The clamp arm 10 can be locked at any position around the periphery of the plunger 11 by use of the slot 20 and locking bolt 24.

The clamp arm 10 is axially restrained on the plunger 11 by a ring 30 that engages the circumferential groove 12 in the plunger 11. The ring 30 is received at the bottom of a counterbore 31 at the upper end of the central opening 16 of the body 15. As shown in FIG. 1, a downward pulling force $F_P$ will be translated into a downward restraining force $F_R$ that acts through the ring 30 and against the bottom of the counterbore 31. This will hold the clamp arm 10 on the plunger against the force $F_C$ exerted on the arm portion 17 by the object being clamped.

The embodiment of FIGS. 3 and 4 incorporates both the locking function and the axial restraint function into a single headed bolt 40. The headed bolt 40 is received in a transverse bore 41 in a body 42 of the clamp arm 43, which also has a central opening 44 for the plunger 45 and a working arm portion 46 extending from the central opening 44. The transverse bore 41 extends both through a radial slot 47 and a portion of the central opening 44. One end 48 of the bore 41 is threaded to receive the end of the bolt 40. The bolt 40 both draws the sides of the slot 47 together to lock the body 42 on the plunger 45 and extends into the central opening 44 to engage a circumferential groove 49 in the plunger 45.

Although the invention is shown in the embodiments of FIGS. 1–4 as being incorporated in a clamp arm having a single working arm portion, it could as well be used in a clamp arm having a pair of working arm portions extending in opposite directions from the central openings 16 or 44. In a double arm clamp arm, a means such as the ring or headed bolt, axially restraining the clamp arm on the plunger is required.

In both embodiments, the mounting of the clamp arm onto the plunger 11 or 45 is accomplished without subjecting the plunger to an axial torque load. Therefore, there is no danger of damage to the clamp cylinder with which the plunger is associated. Furthermore, the plunger has essentially a constant maximum cross-section throughout its length except for the circumferential groove 12 or 49. The transverse bores 22 and 41 are located at about the midpoint of the depth of the central openings 16 and 44, respectively. The locking bolt is thereby located at a neutral axis of the couple formed by the forces resulting from the application of a clamping force on the end of the underside of the clamp arm. The clamp arm in accordance with the present invention allows the use of a plunger having the maximum shaft bending load capacity.

We claim:

1. A clamp arm adapted for attachment to a plunger forming a part of a clamp, comprising:

a body having a central opening for receiving the plunger and at least one working arm portion extending outwardly from the opening, said body also including a slot extending radially from the central opening and a bore in the body that extends transversely through the slot, one portion of the bore being threaded to receive a headed bolt to draw the sides of the slot together to lock the body on the plunger, and means mounted inside the body for axially restraining the body on the plunger including an element mounted for engagement with a circumferential groove on the outer perimeter of the plunger.

2. A clamp arm in accordance with claim 1 wherein said restraining means includes a ring disposed in the groove of the plunger and extending radially outwardly therefrom to engage the bottom of a counterbore in the central opening of the body.

3. A clamp arm in accordance with claim 1 wherein said transverse bore extends tangential to and partially through the central opening and said element is the headed bolt received in the transverse bore.

4. A clamp arm in accordance with claim 1 wherein the slot is narrow adjacent the circumference of the central opening and relatively wide as it extends away from the central opening.

5. A clamp arm assembly for a clamping cylinder, comprising:

a plunger having an outwardly facing circumferential groove adjacent one end; and a clamp arm including a body having a central opening receiving the plunger and at least one working arm portion extending outwardly from the opening, said body also including a slot extending radially from the central opening and a bore in the body that extends transversely through the slot, one portion of the bore being threaded to receive a headed bolt to draw the sides of the slot together to lock the body on the plunger, and means mounted inside the body for axially restraining the body on the plunger including an element mounted for engagement with the groove in the plunger.

6. A clamp arm adapted for attachment to a plunger of a clamping cylinder, comprising:

a body having a central opening for receiving the plunger and at least one working arm portion extending outwardly from the opening, said body also including a slot extending radially from the central opening into the working arm portion and a bore in the body that extends transversely through the slot, the portion of the bore on one side of the slot being threaded, said slot being narrow adjacent the central opening and relatively wide thereafter; and a headed bolt received in the transverse bore for drawing the sides of the slot toward each other to lock the body on the plunger.

7. A clamp arm in accordance with claim 6 wherein the transverse bore is disposed at about the midpoint of the length of the central opening in the body.

8. A clamp arm adapted for attachment to a plunger of a clamping cylinder, comprising:

a body having a central opening for receiving the plunger and at least one working arm portion extending outwardly from the opening, said body also including a slot extending radially from the central opening into the working arm portion and a bore in the body that extends transversely through the slot and tangential to and partially through the opening, the portion of the transverse bore on one side of the slot being threaded; and a headed bolt received in the bore to draw the sides of the slot together to lock the body on the plunger, said bolt having a portion of its surface extending into the opening to engage with a circumferential groove in the plunger.

9. A clamp arm in accordance with claim 8 wherein the transverse bore is disposed at about the midpoint of the length of the central bore in the body.

* * * * *